US006871464B2

(12) United States Patent
Hung

(10) Patent No.: US 6,871,464 B2
(45) Date of Patent: Mar. 29, 2005

(54) DOOR STRUCTURE FOR PREVENTING WATER LEAKAGE

(76) Inventor: Liu Hui Hung, C/- PMB#1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 187 days.

(21) Appl. No.: 10/409,193

(22) Filed: Apr. 9, 2003

(65) Prior Publication Data

US 2004/0200169 A1 Oct. 14, 2004

(51) Int. Cl.[7] ..... E06B 3/70
(52) U.S. Cl. ..... 52/455; 52/456; 52/457; 52/784.1
(58) Field of Search ..... 52/455, 456, 457, 52/784.1; 49/498.1, 475.1; 405/87

(56) References Cited

U.S. PATENT DOCUMENTS 5,119,593 A * 6/1992 Bae ..... 49/501
5,743,057 A * 4/1998 Martin ..... 52/457
6,311,454 B1 * 11/2001 Kempel ..... 52/784.15
6,453,638 B2 * 9/2002 Chen ..... 52/784.15
6,619,010 B2 * 9/2003 Wang Chen ..... 52/784.13
6,688,064 B1 * 2/2004 Swanick ..... 52/455
6,748,711 B2 * 6/2004 Hartel ..... 52/456
6,764,625 B2 * 7/2004 Walsh et al. ..... 264/119

* cited by examiner

*Primary Examiner*—Carl D. Friedman
*Assistant Examiner*—Nahid Amiri
(74) *Attorney, Agent, or Firm*—Leong C. Lei

(57) ABSTRACT

A door structure for preventing water leakage is disclosed. The door structure comprises two sides pillars having an opening at the side and having frame with hollow passage and a waterproof stripe being disposed at the front side of the passage and a pressing stripe being provided at the inner side, the side end face of the side pillar being a plurality of isolated pressing seat having screw holes mounted with a bolt shaft coupled to the pressing stripe, the external side of the side pillar being an engaging slot having mounted with a waterproof plate, the engaging slot engaged with an engaging pillar having an external side mounted with a waterproof plate, screw nuts being used to mount the side pillars to the wall or pillar body of the entrance/opening to the building, the bottom side of the side pillar being a waterproof pad; and a plurality of gating plates being elongated plate body having recesses at the bottom side and the upper side being protruded engaging stripe, and the end face of the recess provided with a waterproof plate and the recess at the lowest gate plate being a waterproof stripe, and a flat pad being provided to the ground, thereby the side pillars allow the gate plates to stack to form a sealed waterproof wall.

11 Claims, 16 Drawing Sheets

DOOR STRUCTURE FOR PREVENTING WATER LEAKAGE

BACKGROUND OF THE INVENTION (a) Technical Field of the Invention

The present invention relates to a door structure, and in particular, to a door structure which is used to block water from entering via exits or openings of a building.

(b) Description of the Prior Art

Most of the tall buildings are built with basements and during a thunderstorm or flood, water may enter the basements through the entrance (openings) of the building. Conventional type of doors for the opening is operated by electricity; however, it is not economical and further, the doors are not waterproof to prevent water from entering the basement.

Therefore, it is an object of the present invention to provide a door structure which can effectively block water from entering via exits or openings of a building.

SUMMARY OF THE INVENTION

Accordingly, it is an object of the present invention to provide a door structure for preventing water leakage comprising two sides pillars having an opening at the side and having frame with hollow passage and a waterproof stripe being disposed at the front side of the passage and a pressing stripe being provided at the inner side, the side end face of the side pillar being a plurality of isolated pressing seat having screw holes mounted with a bolt shaft coupled to the pressing stripe, the external side of the side pillar being an engaging slot having mounted with a waterproof plate, the engaging slot engaged with an engaging pillar having an external side mounted with a waterproof plate, screw nuts being used to mount the side pillars to the wall or pillar body of the entrance/opening to the building, the bottom side of the side pillar being a waterproof pad; and a plurality of gating plates being elongated plate body having recesses at the bottom side and the upper side being protruded engaging stripe, and the end face of the recess provided with a waterproof plate and the recess at the lowest gate plate being a waterproof stripe, and a flat pad being provided to the ground, thereby the side pillars allow the gate plates to stack to form a sealed waterproof wall.

Yet another object of the present invention is to provide a door structure for preventing water leakage, wherein the opening of the engaging pillar is sealed with a sealing cap.

Still another object of the present invention is to provide a door structure for preventing water leakage, wherein the upper side end of the gate plate is a pressing element to allow the gate plate to be stacked to form a seal.

A further object of the present invention is to provide a door structure for preventing water leakage, wherein the pressing mechanism is a side tube within a main tube and is retractable, the main tube is mounted with a present element mounted to the surrounding face of the main tube with a frame body and the pressing element moves up or down along the main body and a screw nut is used to position along the main tube, and a positioning plate is mounted at the frame body, and the two sides of the fixing plate being provided with a bolt shaft, and a press stripe at the bottom side, and the lower side of the press stripe is recessed to correspond to the upper side end of the gate plate.

Other objects, and advantages of the present invention can be more fully understood by reading the following detailed description of the preferred embodiment, with reference to the accompanying drawings.

DETAILED DESCRIPTION OF THE PREFERRED EMBODIMENT

Figure 1:
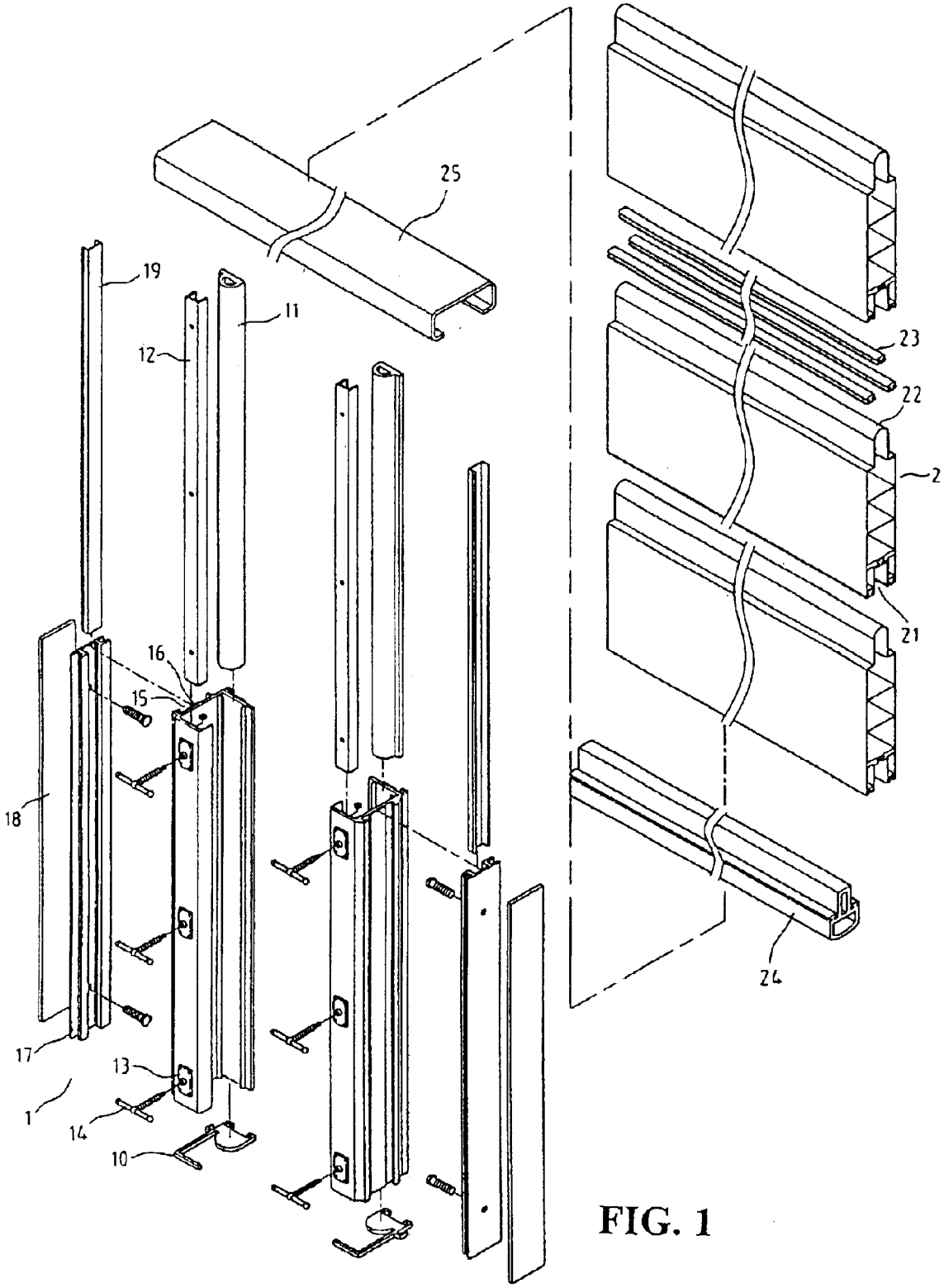
FIG. 1 is an exploded view of the present invention.
Figure 2:
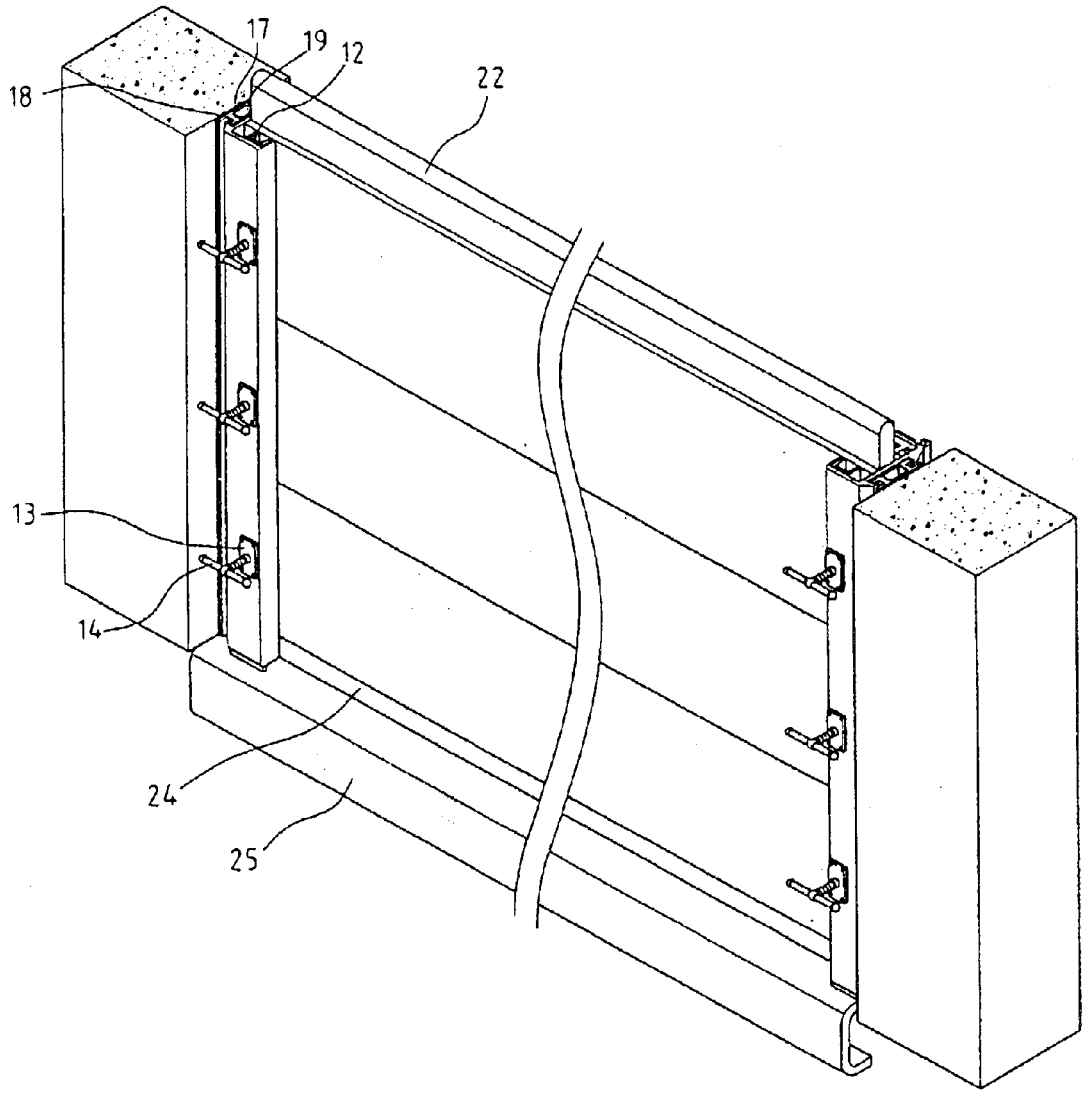
FIG. 2 is a perspective view of FIG. 1 of the present invention.

Referring to FIGS. 1 and 2, there is shown a door structure for preventing water leakage comprising a side pillars 1 and gate plate 2. The pillar 1 has an opening at the side and having frame with hollow passage and a waterproof stripe 11 being disposed at the front side of the passage and a pressing stripe 12 being provided at the inner side, the side end face of the side pillar 1 is with a plurality of isolated pressing seat 13 having screw holes mounted with a bolt shaft 14 coupled to the pressing stripe 12. The external side of the side pillar 1 is an engaging slot 15 having mounted with a waterproof plate 16, the engaging slot 15 engaged with an engaging pillar 17 having an external side mounted with a waterproof plate 18. Screw nuts are used to mount the side pillars 1 to the wall or pillar body of the entrance/opening to the building and the bottom side of the side pillar 1 is a waterproof pad 10; and the side pillar 1 is sealed against the floor to form a waterproof without water leakage.

The gating plates 2 are elongated plate body made from light-weight material having recesses 21 at the bottom side, and the upper side is a protruded engaging stripe 22, and the end face of the recess 21 is provided with a waterproof plate 23 and the recess 21 at the lowest gate plate 2 is a waterproof stripe 24, and a flat pad 25 is provided to the ground, thereby the side pillars 1 allow the gate plates 2 to stack to form a sealed waterproof wall.

Figure 3:
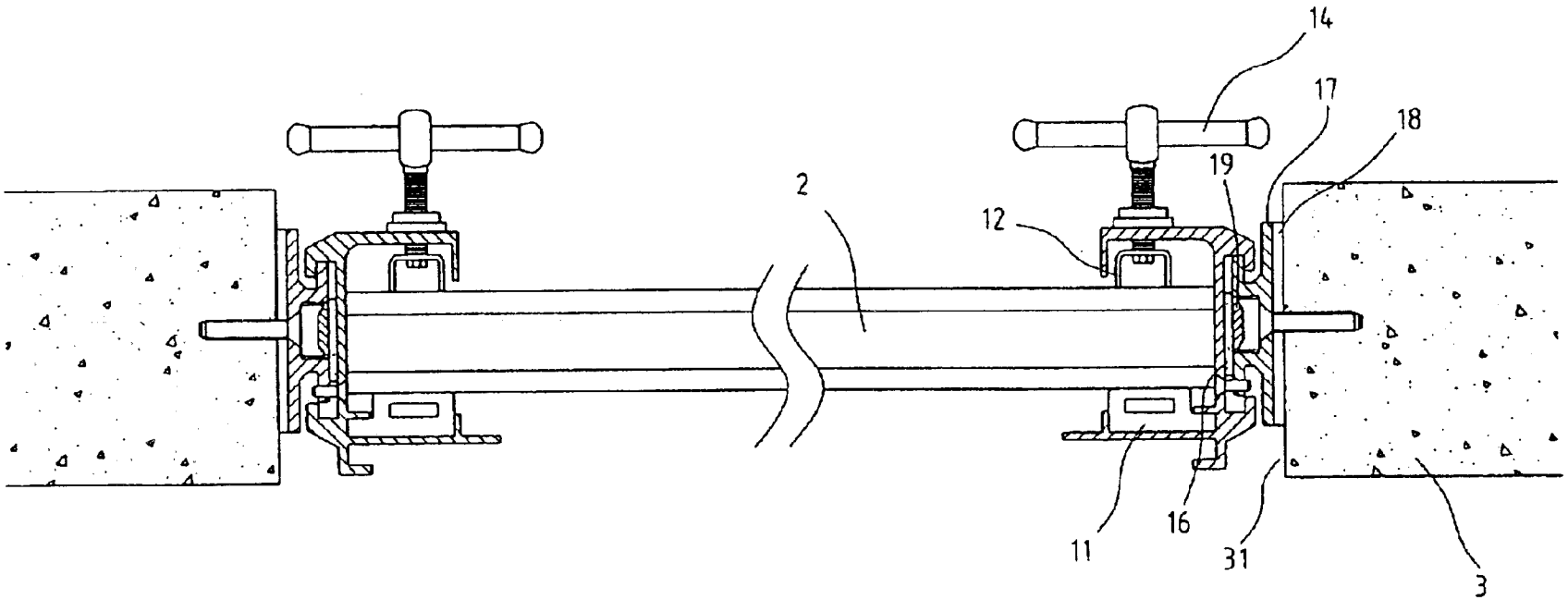
FIG. 3 is a schematic view of the door structure for preventing water leakage in combination with the water-retaining wall.
Figure 4:
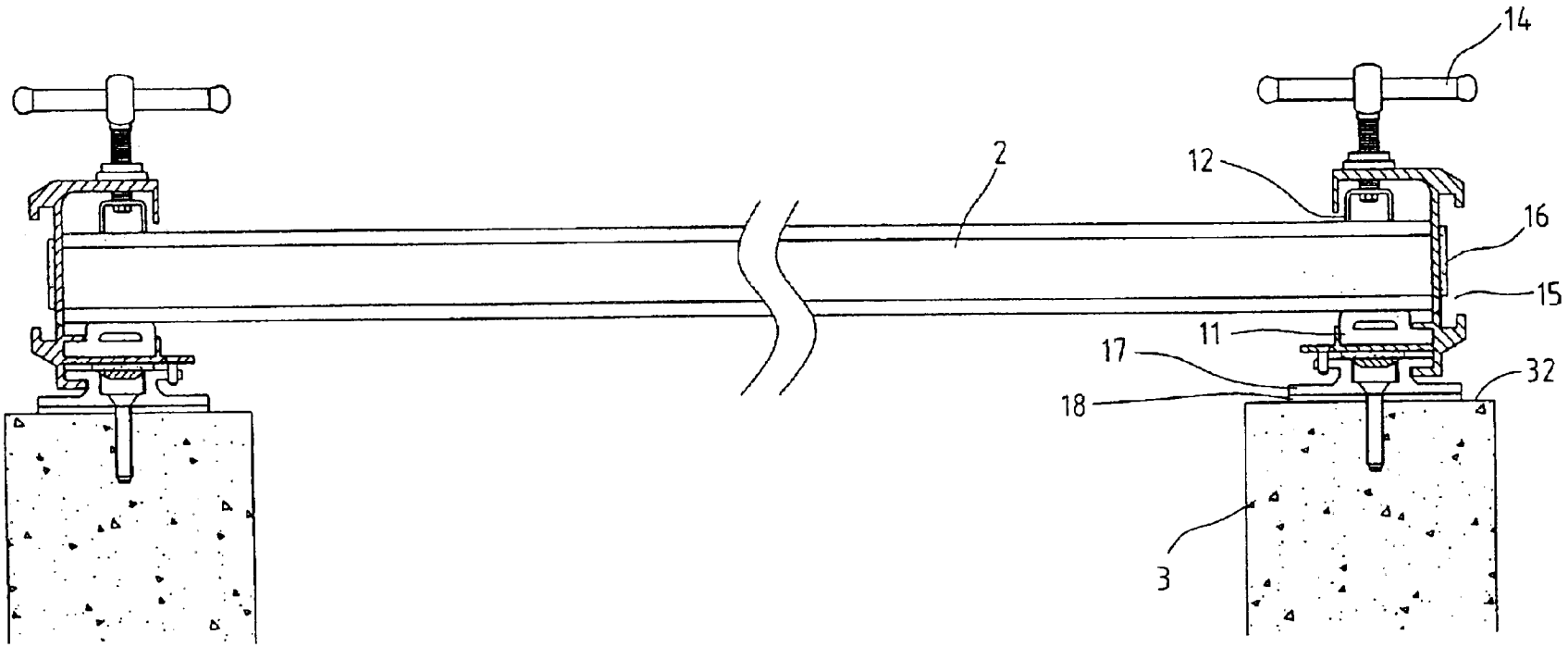
FIG. 4 is a schematic view showing another combination of the door structure for preventing water leakage with the water-retaining wall.
Figure 5:
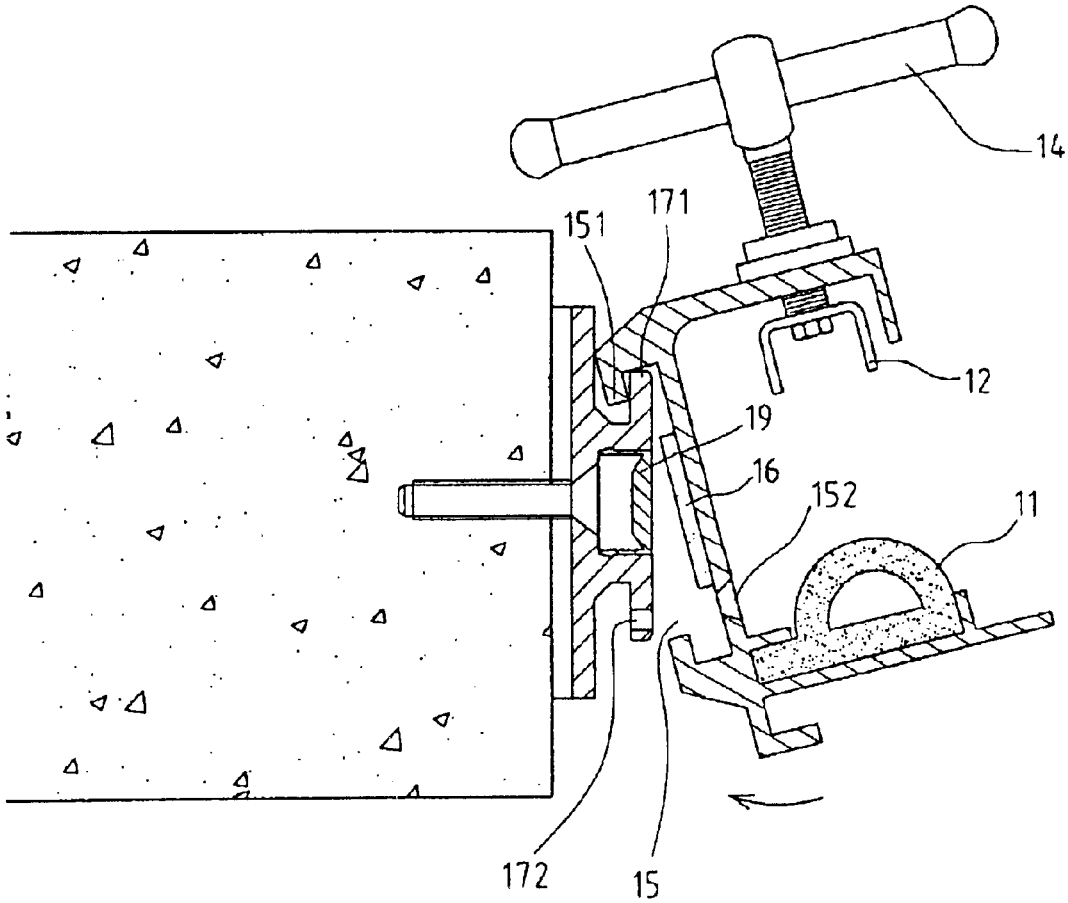
FIG. 5 is a schematic view showing the side pillar and the engaging pillar prior to combination of the present invention.
Figure 6:
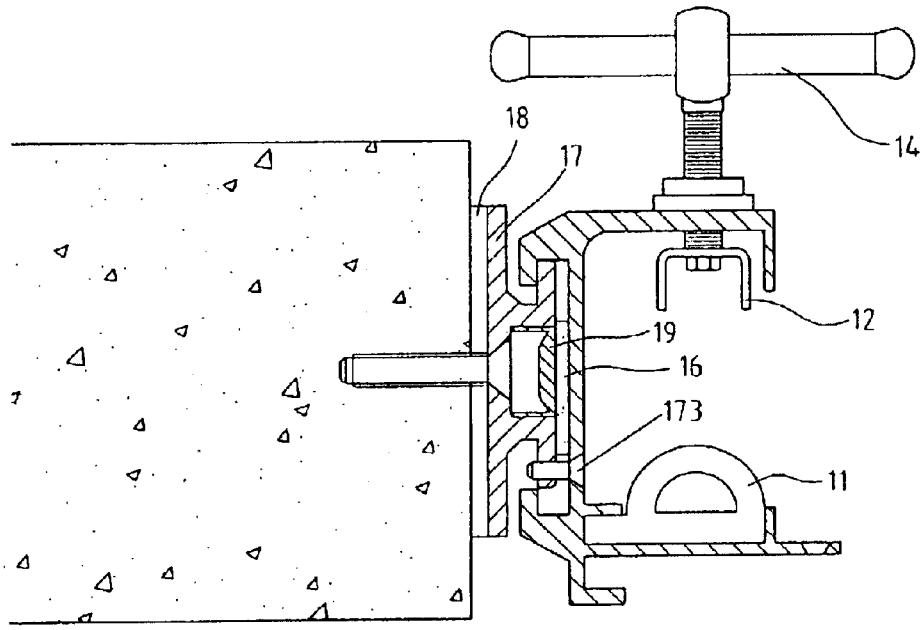
FIG. 6 is a schematic view showing the side pillar and the engaging pillar after to combination of the present invention.
Figure 7:
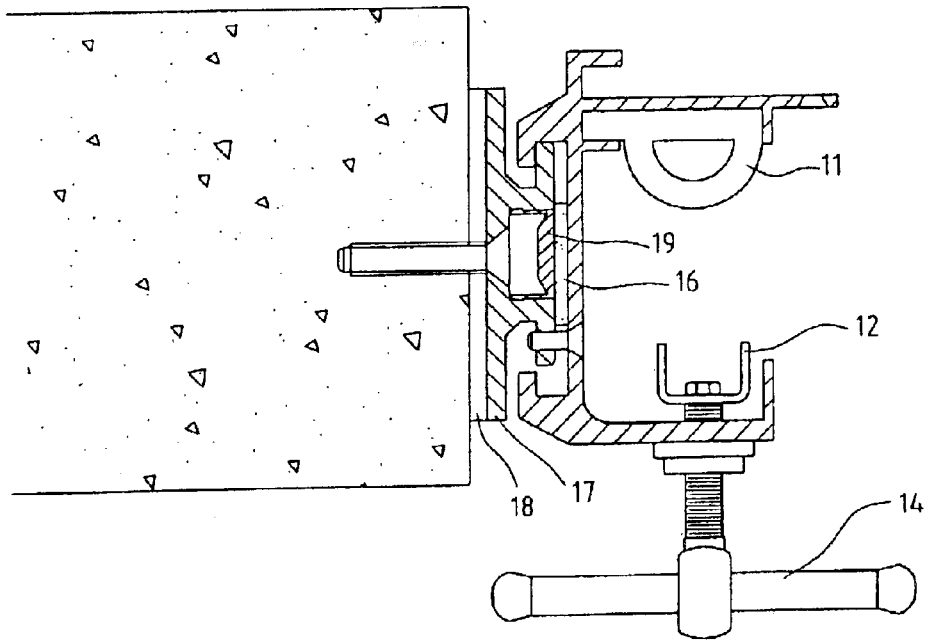
FIG. 7 is another schematic view showing the side pillar and the engaging pillar after combination in accordance with the present invention.
Figure 8:
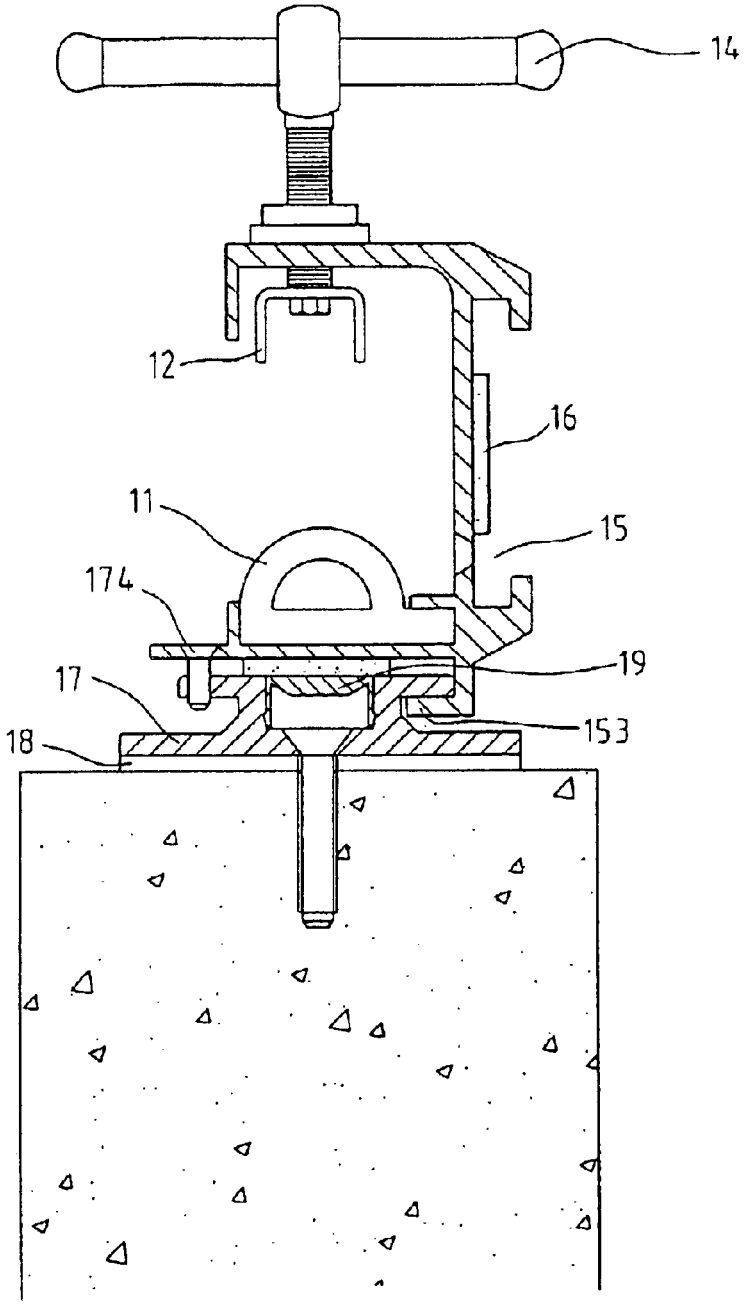
FIG. 8 is a further schematic view showing the side pillar and the engaging pillar after combination in accordance with the present invention.
Figure 9:
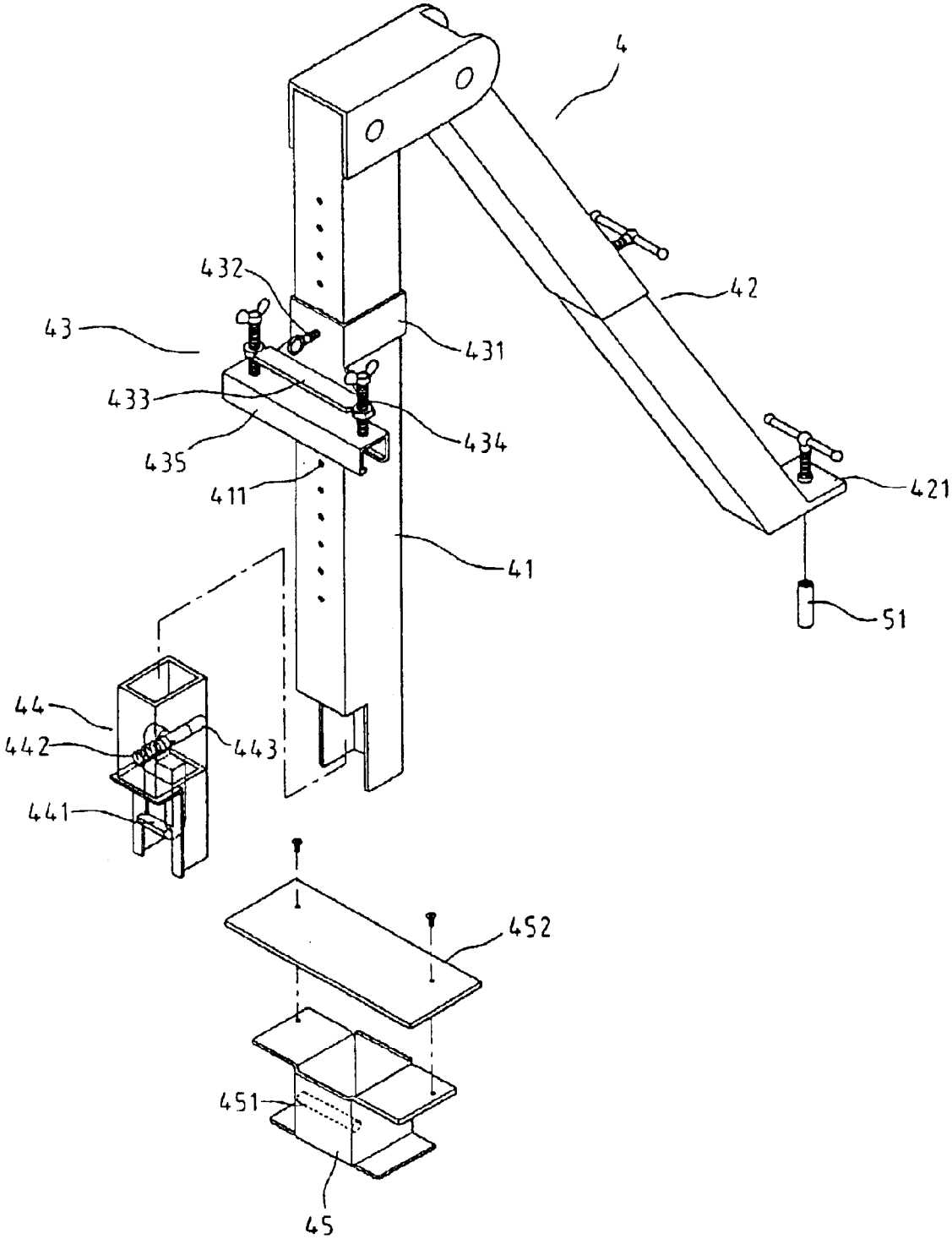
FIG. 9 is an exploded view of the pressing mechanism of the present invention.

Referring to FIGS. 3 and 4, the upper side end of the gate plate 2 is a pressing stripe 12 to allow the gate plate 2 to be stacked to form a seal.

As shown in FIGS. 5, 6, 7, 8 and 9, the pressing mechanism 42 is a side tube 42 within a main tube 41 and is retractable. The main tube 41 is mounted with a pressing element 43 mounted to the surrounding face of the main tube 41 with a frame body 431 and the pressing element 43 moves up or down along the main tube 42 and a screw nut 432 is used to position along the main tube 41, and a positioning plate 433 is mounted at the frame body 431, and the two sides of the positioning plate 433 being provided with a bolt shaft 434, and a press stripe 435 at the bottom side, and the lower side of the press stripe 435 is recessed to correspond to the upper side end of the gate plate 2.

Figure 10:
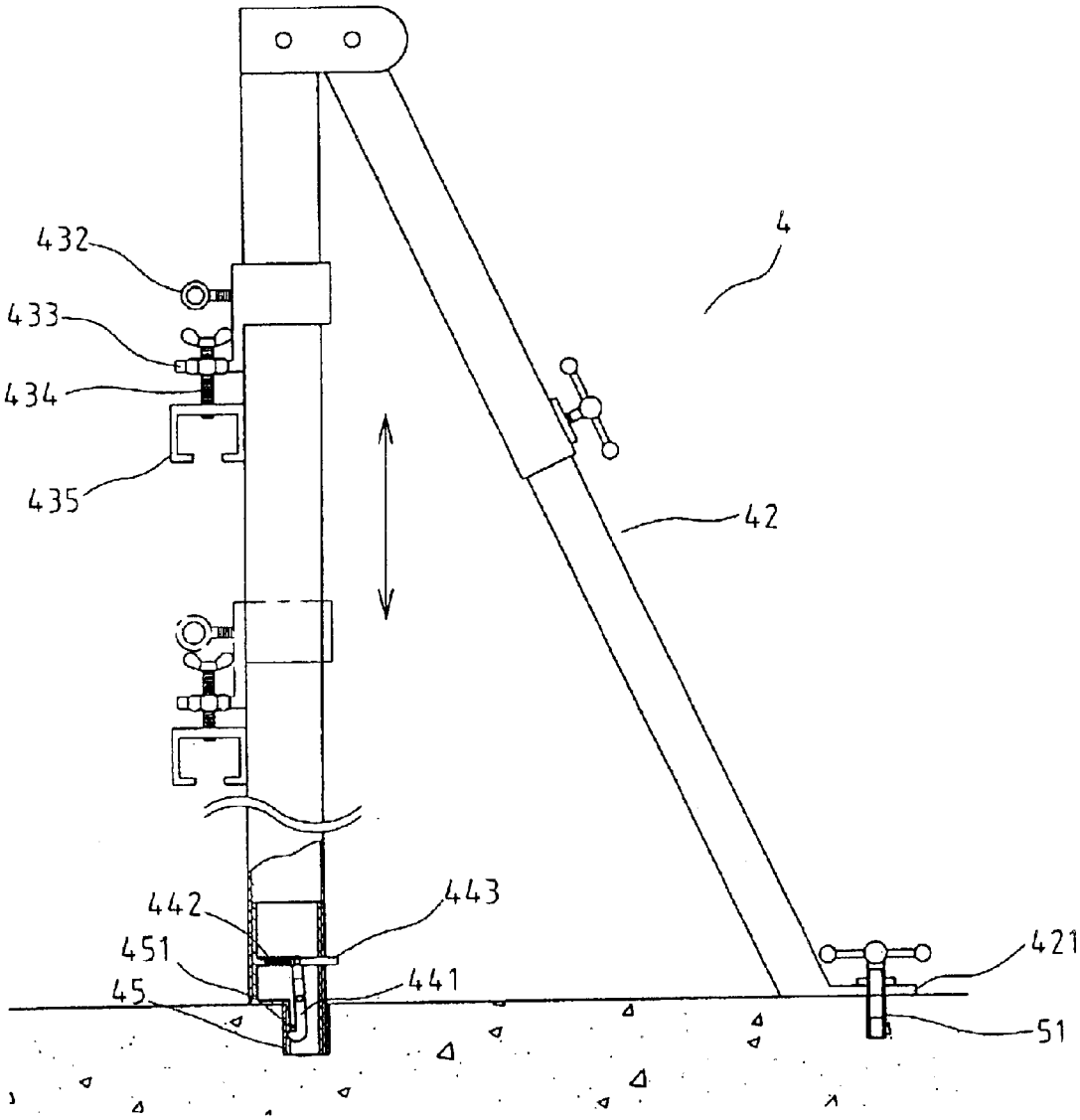
FIG. 10 is a side view of the pressing mechanism of the present invention.

As shown in FIG. 10, a protruded plate 421 is positioned at the bottom side of the side tube 42, and the protruded plate 421 is provided with a bolt shaft 422 to correspond to a screw tube 51 so that the side tube 42 is positioned at the screw tube 51.

The bottom side of the main tube 41 is mounted with a combination frame 4 having a hook body 441 at the bottom side thereof and the frame 44 is controlled by a press shaft 443 mounted with a spring 442 to cause a front and rear swinging, and a positioning seat 45 is disposed corresponding to the ground and the wall of the front side of the positioning seat 45 is extended with a hook plate 451, the main tube 41 is positioned at a hollow space at the positioning seat 45 by the combination frame 44, and the hook body 441 is mounted at the hook plate 451 of the front wall of the positioning seat 45 for securing.

Figure 11:
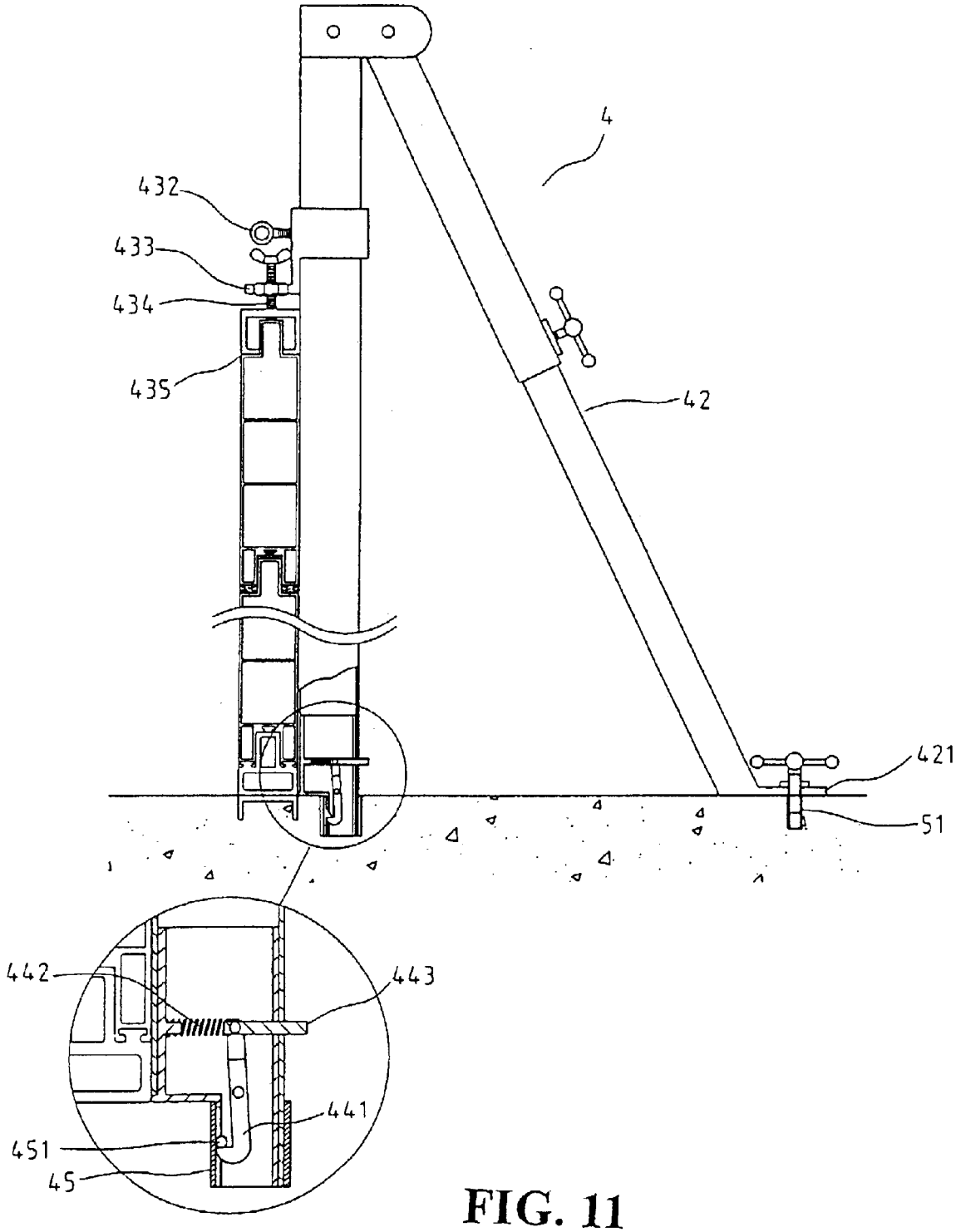
FIG. 11 is a schematic view showing the combination of the pressing mechanism with the retention wall.
Figure 12:
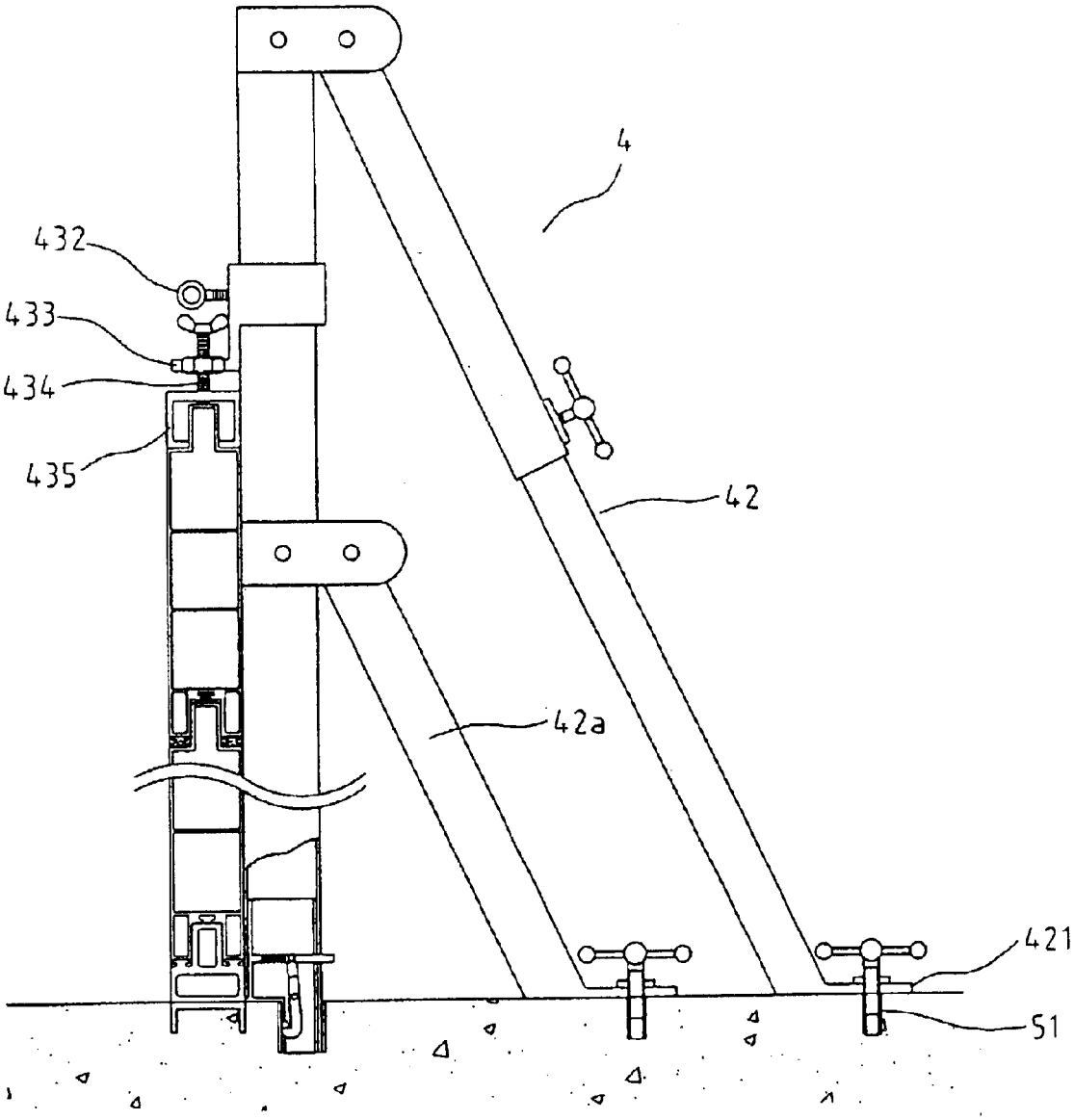
FIG. 12 is another preferred embodiment of the pressing mechanism.
Figure 13:
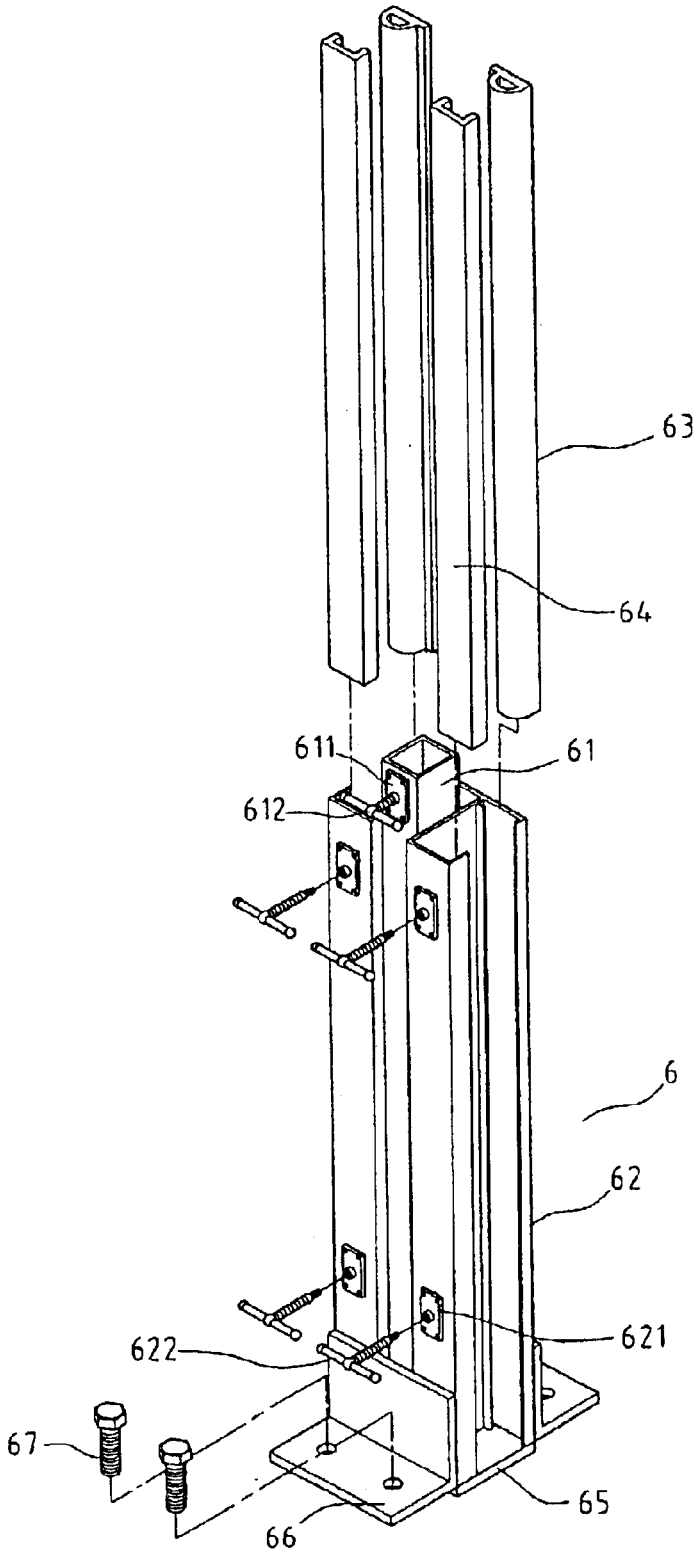
FIG. 13 is an exploded view of the center pillar of the present invention.
Figure 14:
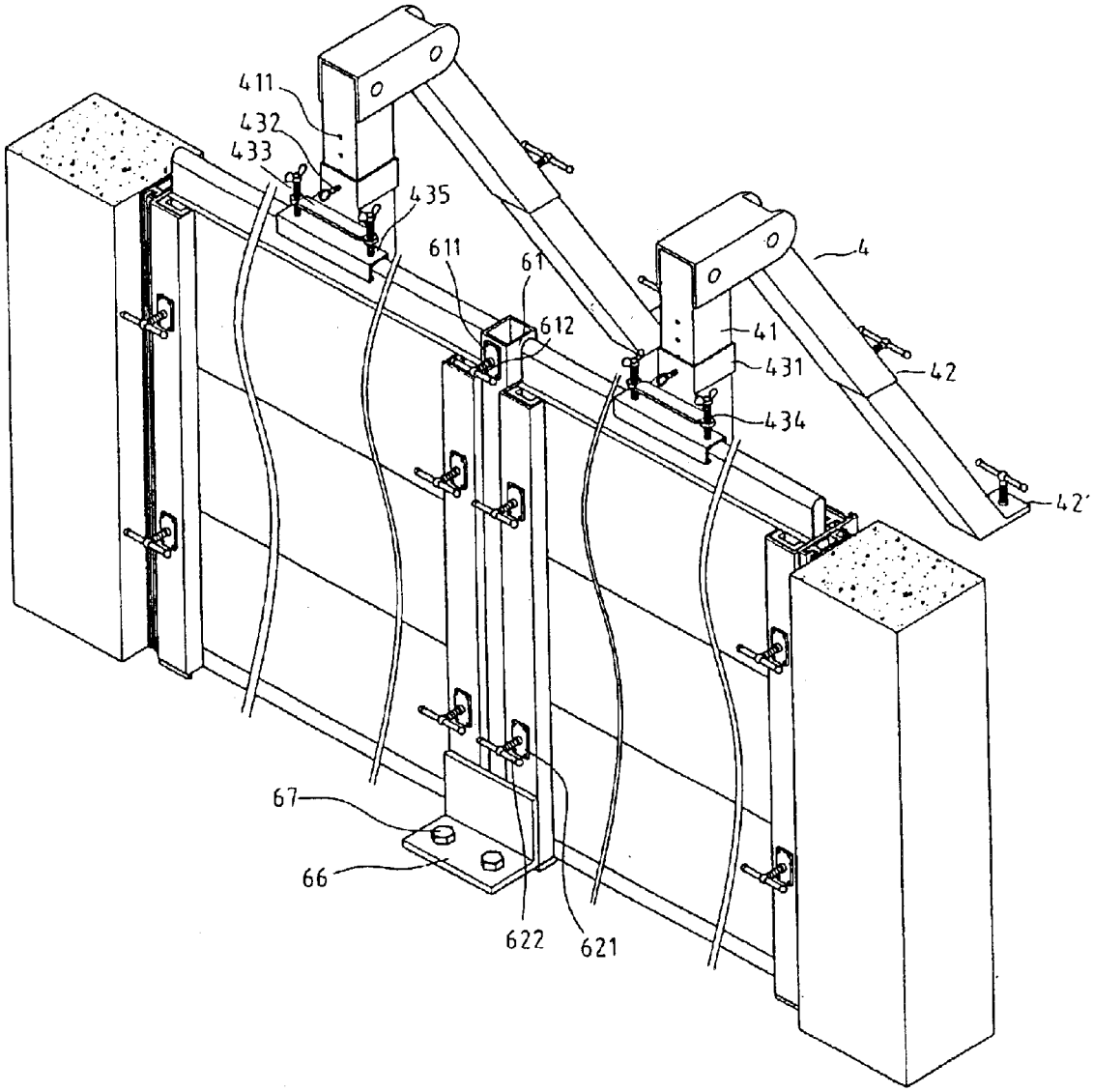
FIG. 14 is a schematic view showing the application of the center pillar.
Figure 15:
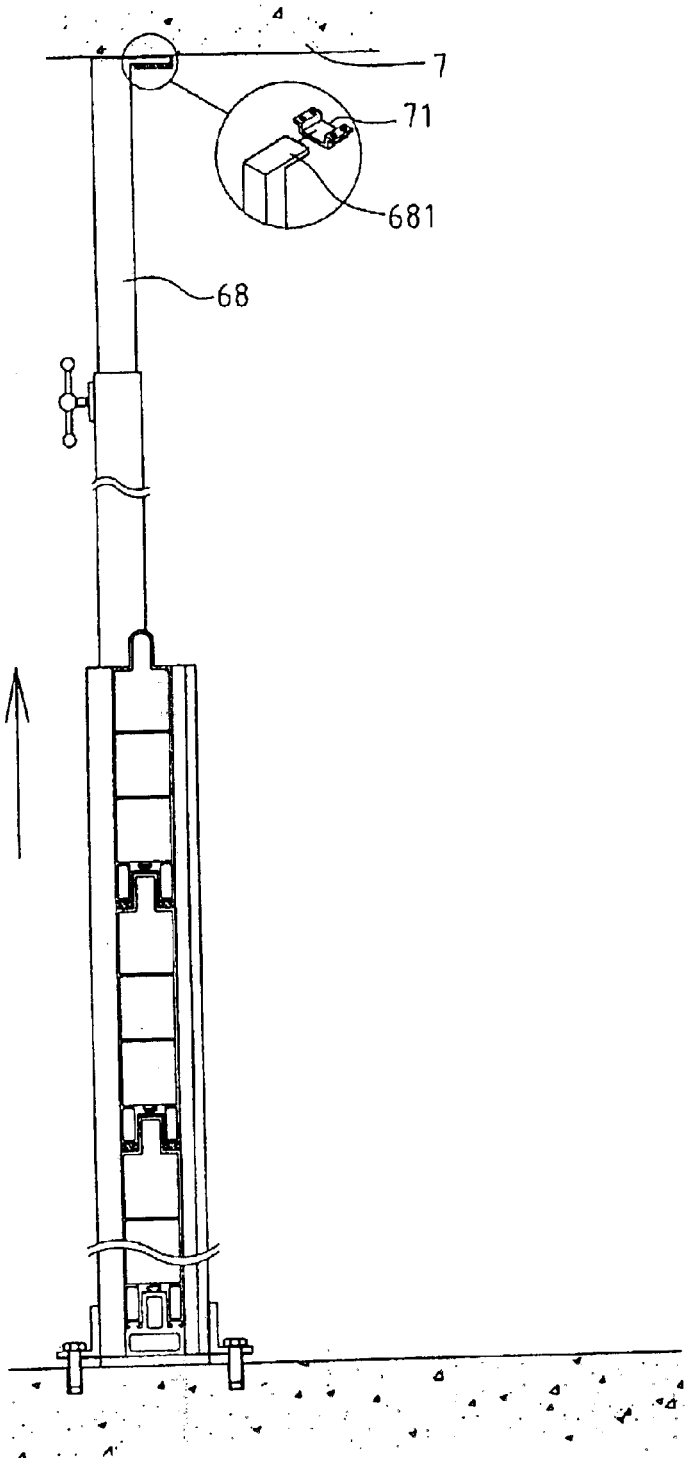
FIG. 15 is a schematic view of the securing of the center pillar.

Referring to FIGS. 11, 12, and 13, the center pillar 6 is a hollow frame tube 61 having the sides extended to form an engaging frame 62, the front side of the engaging frame 62 is mounted with a waterproof stripe 63 and the rear side of the engaging frame 62 is a pressing stripe 64, and the end face of the inner side of the engaging frame 62 is provided with a pressing seat 62 having a screw hole to the inner side of the engaging frame 62, the screw hole is provided with a bolt shaft 622 combined with the pressing stripe 64, and the end face of the bottom side is mounted with a waterproof plate 65 and the front and rear side are extended to form a positing plate 66 having a screw hole from mounting with a screw 67 so that the center pillar 6 is fixed to the ground to be secured between the two side pillars 1, as shown in FIG. 14. The hollow frame tube 61 may be provided with an extension tube 68 having a lug 681 which can be engaged with a hook 71 on the ceiling 7 (see FIG. 15).

Figure 16:
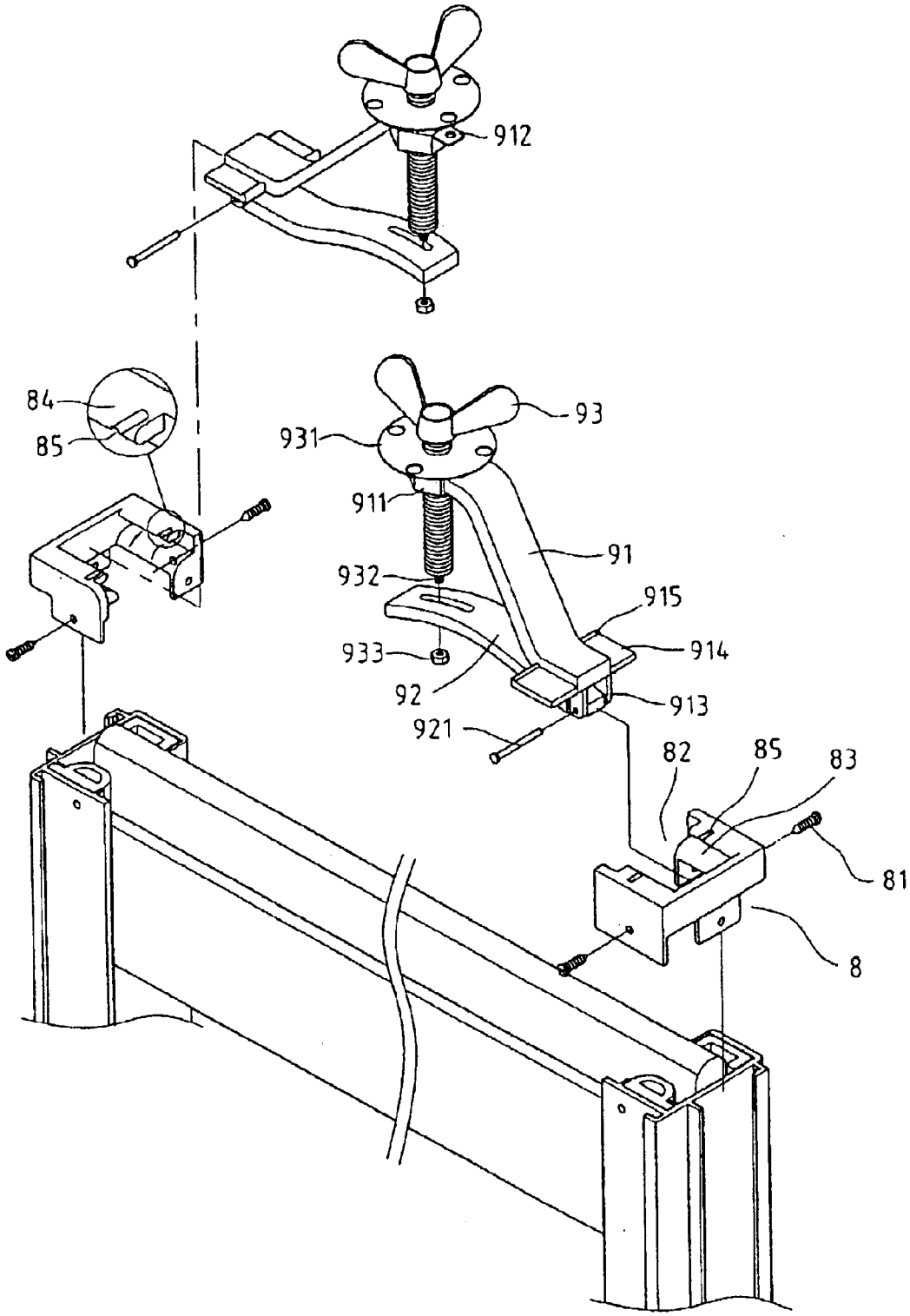
FIG. 16 is an exploded view of the packing mechanism of the present invention.
Figure 17:
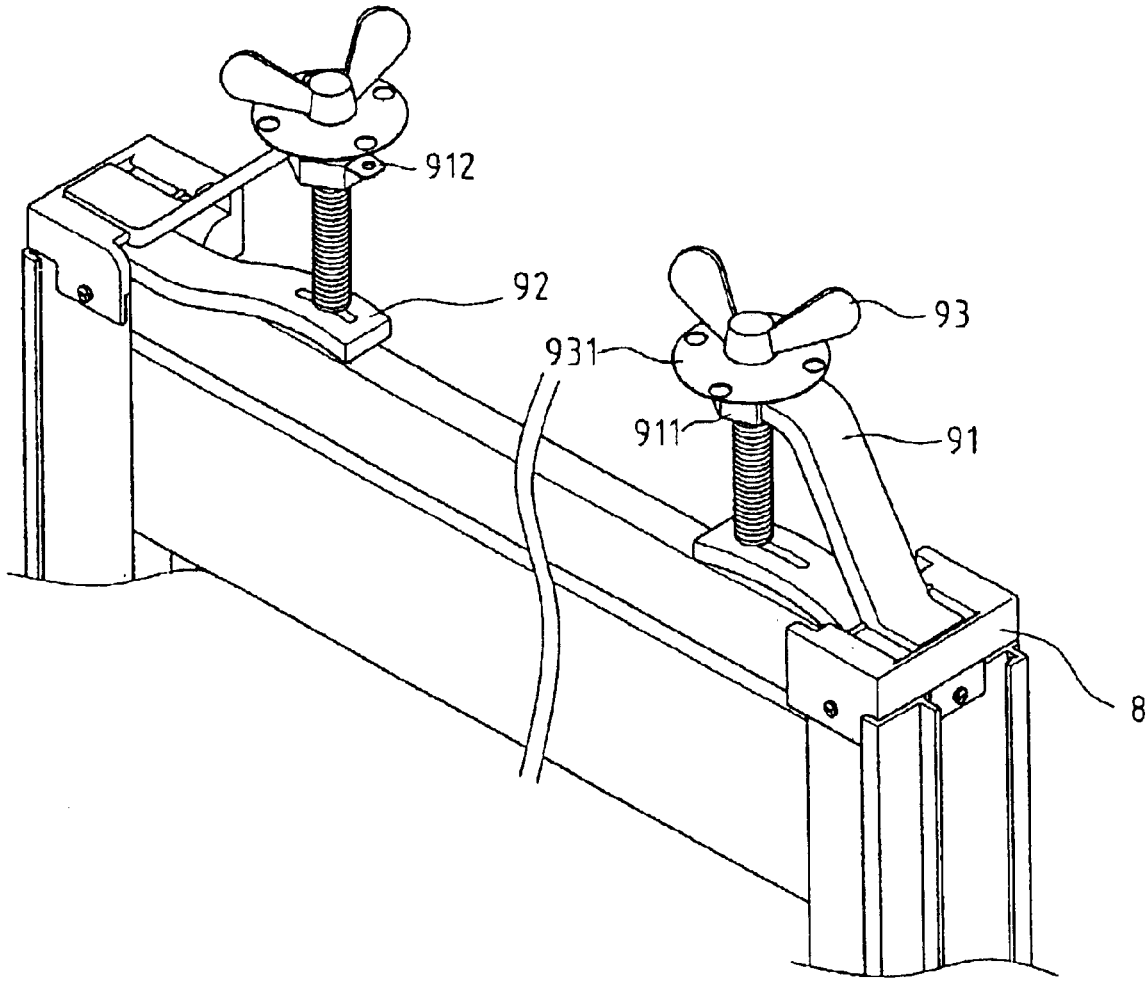
FIG. 17 is a perspective view o the packing mechanism of the present invention.

Referring to FIGS. 16 and 17, the top end faces of the two sides of the gate plate 2 are closely coupled by the seat 8 and an urging element 9, the seat 8 is rectangular with screw 81 to mount the seat 8 to the side pillar 1, the center of the seat 8 is a slot rail 82 having a width to adapt the gate plate 2, and the two sides of the slot rail 82 is a sloping 83 to allow smooth insertion of the gate plate 2, the sloping 83 is provided with a cover plate 84 having the bottom side mounted onto a positioning slot 85 facing upward, the urging element 9 is provided with a pressing plate 92 at the bottom side thereof and the front side of the base plate 91 is an adjusting screw rod 53 with a nut 911 at the protruded end of the base plate 91, a peg 921 is used to mount the pressing plate 92 to the frame body 913 of the bottom side of the base plate 91, the two sides of the frame body 913 are provided with a flap 914 having a protruded edge 91 at the front end thereof, and the front end of the pressing plate 92 corresponding to the elongated and tapered recess hole 922, and the bottom side of the shaft body is a screw rod 932 of smaller diameter which can mount into the recess hole 922 of the press plate 92 to combine with the screw nut 933 so that the screw shaft 93 will not dislocate from the press plate 92.

During flooding, the gate plates 2 are stacked to form a water-retention wall and flaps 914 are inserted into the gap between the cover plates 84. The protruded edge 915 is engaged at the positioning slot 85 to position the urging mechanism 9. Next, the adjusting screw rod 93 is rotated to cause the pressing plate 92 to move downward. The gate plates 2 form into a pressing force so that the gate plates 2 are closely coupled to form a water-retention wall. At the same time, the downward force is proportional to the length of the adjustable screw rod 93. Thus based on the width of the gate plate 2, the length of the screw rod 93 is adjusted so as to ensure the close coupling of the water-retention wall. The locking plate 912 at the front side of the nut 911, allows the door structure for preventing water leakage is locked.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. A door structure for preventing water leakage comprising:

(a) two sides pillars having an opening at the side and having frame with hollow passage and a waterproof stripe being disposed at the front side of the passage and a pressing stripe being provided at the inner side, the side end face of the side pillar being a plurality of isolated pressing seat having screw holes mounted with a bolt shaft coupled to the pressing stripe, the external side of the side pillar being an engaging slot having mounted with a waterproof plate, the engaging slot engaged with an engaging pillar having an external side mounted with a waterproof plate screw nuts being used to mount the side pillars to the wall or pillar body of the entrance/opening to the building, the bottom side of the side pillar being a waterproof pad; and (b) a plurality of gating plates being elongated plate body having recesses at the bottom side and the upper side being protruded engaging stripe, and the end face of the recess provided with a waterproof plate and the recess at the lowest gate plate being a waterproof stripe, and a flat pad being provided to the ground, thereby the side pillars allow the gate plates to stack to form a sealed waterproof wall.

2. The door structure for preventing water leakage of claim 1, wherein the opening of the engaging pillar is sealed with a sealing cap.

3. The door structure for preventing water leakage of claim 1, wherein the upper side end of the gate plate is a pressing element to allow the gate plate to be stacked to form a seal.

4. The door structure for preventing water leakage of claim 3, wherein the pressing mechanism is a side tube within a main tube and is retractable, the main tube is mounted with a present element mounted to the surrounding face of the main tube with a frame body and the pressing element moves up or down along the main body and a screw nut is used to position along the main tube, and a positioning plate is mounted at the frame body, and the two sides of the fixing plate being provided with a bolt shaft, and a press stripe at the bottom side, and the lower side of the press stripe is recessed to correspond to the upper side end of the gate plate.

5. The door structure for preventing water leakage of claim 4, wherein a protruded plate is positioned at the bottom side of the side tube, and the protruded plate is provided with a bolt shaft to correspond to a screw tube so that the side tube is positioned at the screw tube.

6. The door structure for preventing water leakage of claim 4, wherein the bottom side of the main tube is mounted with a combination frame having a hook body at the bottom side thereof and the frame is controlled by a press shaft mounted with a spring to cause a front and rear swinging, and a positioning seat is disposed corresponding to the ground and the wall of the front side of the positioning seat is extended with a hook plate, the main tube is positioned at a hollow space at the positioning seat by the combination frame, and the hook body is mounted at the hook plate of the front wall of the positioning seat for securing.

7. The door structure for preventing water leakage of claim 4, wherein the main tube is extended to form a second side tube.

8. The door structure for preventing water leakage of claim 1, wherein a center pillar is positioned between the two side pillars.

9. The door structure for preventing water leakage of claim 8, wherein the center pillar is a hollow frame tube having the sides extended to form an engaging frame, the front side of the engaging frame is mounted with a waterproof stripe and the rear side of the engaging frame is a pressing stripe, and the end face of the inner side of the engaging frame is provided with a pressing seat having a screw hole to the inner side of the engaging frame, the screw hole is provided with a bolt shaft combined with the pressing stripe, and the end face of the bottom side is mounted with a waterproof plate and the front and rear side are extended to form a fixing plate having a screw hole from mounting with a screw so that the center pillar is fixed to the ground to be secured between the two side pillars.

10. The door structure for preventing water leakage of claim 8, wherein the top end of the frame tube is provided with a pressing seat having a screw hole to the hollow space at the interior of the frame, and the hollow space is mounted with an extended long tube, the tube is extended with a protruded plate which can be engaged with a hook plate mounted to ceiling.

11. The door structure for preventing water leakage of claim 1, wherein the top end faces of the two sides of the gate plate are closely coupled by the seat and an urging element, the seat is rectangular with screw to mount the seat to the side pillar, the center of the seat is a slot rail having a width to adapt the gate plate, and the two sides of the slot rail is a sloping to allow smooth insertion of the gate plate, the sloping is provided with a cover plate having the bottom side mounted onto a positioning slot facing upward, the urging element is provided with a pressing plate at the bottom side thereof and the front side of the base plate is an adjusting screw rod with a nut at the protruded end of the base plate, a peg is used to mount the pressing plate to the frame body of the bottom side of the base plate, the two sides of the frame body are provided with a flap having a protruded edge at the front end thereof, and the front end of the pressing plate corresponding to the elongated and tapered recess hole, and the bottom side of the shaft body is a screw rod of smaller diameter which can mount into the recess hole of the press plate to combine with the screw nut so that the screw shaft will not dislocate from the press plate.

* * * * *